US007013102B2

(12) United States Patent
Ehara

(10) Patent No.: US 7,013,102 B2
(45) Date of Patent: Mar. 14, 2006

(54) IMAGE FORMING APPARATUS AND METHOD FOR PREVENTING LOCAL DAMAGE OF GEARS AND CONTROLLING DEVIATION OF POSITION OF COLOR IMAGES

(75) Inventor: Yasuhisa Ehara, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 10/724,780

(22) Filed: Dec. 2, 2003

(65) Prior Publication Data

US 2004/0161263 A1 Aug. 19, 2004

(30) Foreign Application Priority Data

Dec. 2, 2002 (JP) ..... 2002-350535
May 16, 2003 (JP) ..... 2003-139355

(51) Int. Cl.
*G03G 15/00* (2006.01)
*G03G 15/01* (2006.01)

(52) U.S. Cl. ..... 399/167; 399/82; 399/299

(58) Field of Classification Search ..... 399/167, 399/82, 75, 159, 298, 299; 347/115, 117
See application file for complete search history.

(56) References Cited

U.S. PATENT DOCUMENTS 5,970,286 A * 10/1999 Numazu et al. ..... 399/167
6,360,070 B1 * 3/2002 Taka et al. ..... 399/299 X
2003/0021613 A1 * 1/2003 Koide ..... 399/167
2003/0152402 A1 * 8/2003 Ehara et al. ..... 399/167

FOREIGN PATENT DOCUMENTS

| | | | |
|---|---|---|---|
| EP | 0 895 132 | | 2/1999 |
| JP | 07-181773 A | * | 7/1995 |
| JP | 9-179372 | | 7/1997 |
| JP | 11-084799 A | * | 3/1999 |
| JP | 2000-187428 | | 7/2000 |
| JP | 2000-293003 A | * | 10/2000 |
| JP | 2002-062706 A | * | 2/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes at least one first image carrier that carries a chromatic color toner image formed thereon, a second image carrier that carries a black toner image formed thereon, at least one first gear that rotates to drive the first image carrier to rotate, a second gear that rotates to drive the second image carrier to rotate, and a control device that controls respective rotation stop-positions of the first and second gears. The control device controls the first gear and the second gear to stop rotating at positions different from rotation start-positions of the first gear and the second gear, respectively, while maintaining a predetermined phase relation between the first gear and the second gear in a color mode, and the control device controls the second gear to stop rotating at a position substantially equal to a rotation start-position of the second gear in a monochrome mode.

11 Claims, 4 Drawing Sheets

IMAGE FORMING APPARATUS AND METHOD FOR PREVENTING LOCAL DAMAGE OF GEARS AND CONTROLLING DEVIATION OF POSITION OF COLOR IMAGES

CROSS-REFERENCE TO RELATED APPLICATIONS

The present application claims priority to Japanese Patent Application No. 2002-350535 filed in the Japanese Patent Office on Dec. 2, 2002 and Japanese Patent Application No. 2003-139355 filed in the Japanese Patent Office on May 16, 2003, the disclosures of which are incorporated herein by reference in their entirety.

BACKGROUND OF THE INVENTION

1. Field of the Invention

The present invention relates to an image forming apparatus, such as, a copying machine, a printer, a facsimile machine, a multifunctional image forming apparatus, or other similar image forming apparatuses, that forms a color image in a color mode and forms a black image in a monochrome mode.

2. Discussion of the Background

In a color image forming apparatus, such as, a copying machine, a printer, a facsimile machine, a multifunctional image forming apparatus, or other similar image forming apparatuses, both a mono-color (i.e., black) image and a multi-color image can be formed. In this type of image forming apparatus, at least one gear (hereafter may be simply referred to as a "color gear") for driving and rotating an image carrier that carries a color toner image (hereafter may be simply referred to as a "color image carrier") and a gear (hereafter may be simply referred to as a "black gear") for driving and rotating an image carrier that carries a black toner image (hereafter may be simply referred to as a "black image carrier") start rotating and stop in accordance with the start and stop of an image forming operation. In this condition, when the color gear and the black gear start rotating and stop, these gears and gears meshed with the color gear and the black gear are under heavy load conditions. Therefore, if the color gear and the black gear constantly stop at the same positions, each of the same positions of the color gear and the black gear is repeatedly under a heavy load, thereby causing the color gear and black gear to be damaged locally. As a result, the useful life of the color gear and black gear is reduced.

If the color gear and the black gear stop at positions different from their rotation start-positions, respectively, the useful life of the color gear and black gear can be prevented from reducing. However, the following problem may occur with this construction.

Generally, color gears and a black gear are arranged with predetermined phase relations kept therebetween to prevent the deviation of the position of color toner images transferred onto a transfer material. By keeping the phase relations between the color gears and the black gear, the occurrence of the deviation of the position of color toner images is effectively controlled. For example, published Japanese patent application No. 2000-187428 describes this technique. However, in a monochrome mode in which color gears and a color image carrier are halted and a black toner image is formed on a black image carrier while driving the black image carrier to rotate by the black gear, if the black gear is stopped at a position different from its rotation start-position, the predetermined phase relations between the black gear and the color gears are changed, thereby causing the occurrence of the deviation of the position of color toner images formed by subsequent image forming operations.

Therefore, it is desirable to provide an image forming apparatus that prevents local damage of color gears and a black gear, and that effectively controls the deviation of the position of color images.

SUMMARY OF THE INVENTION

According to an aspect of the present invention, an image forming apparatus includes at least one first image carrier configured to carry a chromatic color toner image formed thereon, a second image carrier configured to carry a black toner image formed thereon, at least one first gear configured to rotate to drive the at least one first image carrier to rotate, a second gear configured to rotate to drive the second image carrier to rotate, and a control device configured to control respective rotation stop-positions of the at least one first gear and the second gear. A color image is formed in a color mode by transferring the chromatic color toner image formed on the at least one first image carrier onto a transfer material and by transferring the black toner image formed on the second image carrier onto the transfer material while superimposing each other on the transfer material, and a black image is formed in a monochrome mode by halting the at least one first gear and the at least one first image carrier and by transferring the black toner image formed on the second image carrier onto the transfer material. The control device controls the at least one first gear and the second gear to stop rotating at positions different from rotation start-positions of the at least one first gear and the second gear, respectively, while maintaining a predetermined phase relation between the at least one first gear and the second gear in the color mode, and the control device controls the second gear to stop rotating at a position substantially equal to a rotation start-position of the second gear in the monochrome mode.

Color registration of color images is performed in a registration mode, and the control device controls the at least one first gear and the second gear to stop rotating at positions substantially equal to rotation start-positions of the at least one first gear and the second gear, respectively, while maintaining a predetermined phase relation between the at least one first gear and the second gear in the registration mode.

According to another aspect of the present invention, a color image forming method includes rotating at least one first gear to drive at least one first image carrier to rotate in a color mode in which a color image is formed, and rotating a second gear to drive a second image carrier to rotate in the color mode, and in a monochrome mode in which a black image is formed; forming a chromatic color toner image on the at least one first image carrier in the color mode, and forming a black toner image on the second image carrier in the color mode and the monochrome mode; transferring the chromatic color toner image formed on the at least one first image carrier onto a transfer material and transferring the black toner image formed on the second image carrier onto the transfer material while superimposing each other on the transfer material in the color mode, and transferring the black toner image formed on the second image carrier onto the transfer material in the monochrome mode; and controlling the at least one first gear and the second gear to stop rotating at positions different from rotation start-positions of the at least one first gear and the second gear, respectively, while maintaining a predetermined phase relation between the at least one first gear and the second gear in the color mode, and controlling the second gear to stop rotating at a position substantially equal to a rotation start-position of the second gear in the monochrome mode.

The color image forming method further includes controlling the at least one first gear and the second gear to stop rotating at positions substantially equal to rotation start-positions of the at least one first gear and the second gear, respectively, while maintaining a predetermined phase relation between the at least one first gear and the second gear in a registration mode in which color registration of color images is performed.

The color image forming method further includes causing the at least one first gear and the second gear to equally shift by a predetermined rotation angle after a predetermined number of black image forming operations are continuously performed in the monochrome mode.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
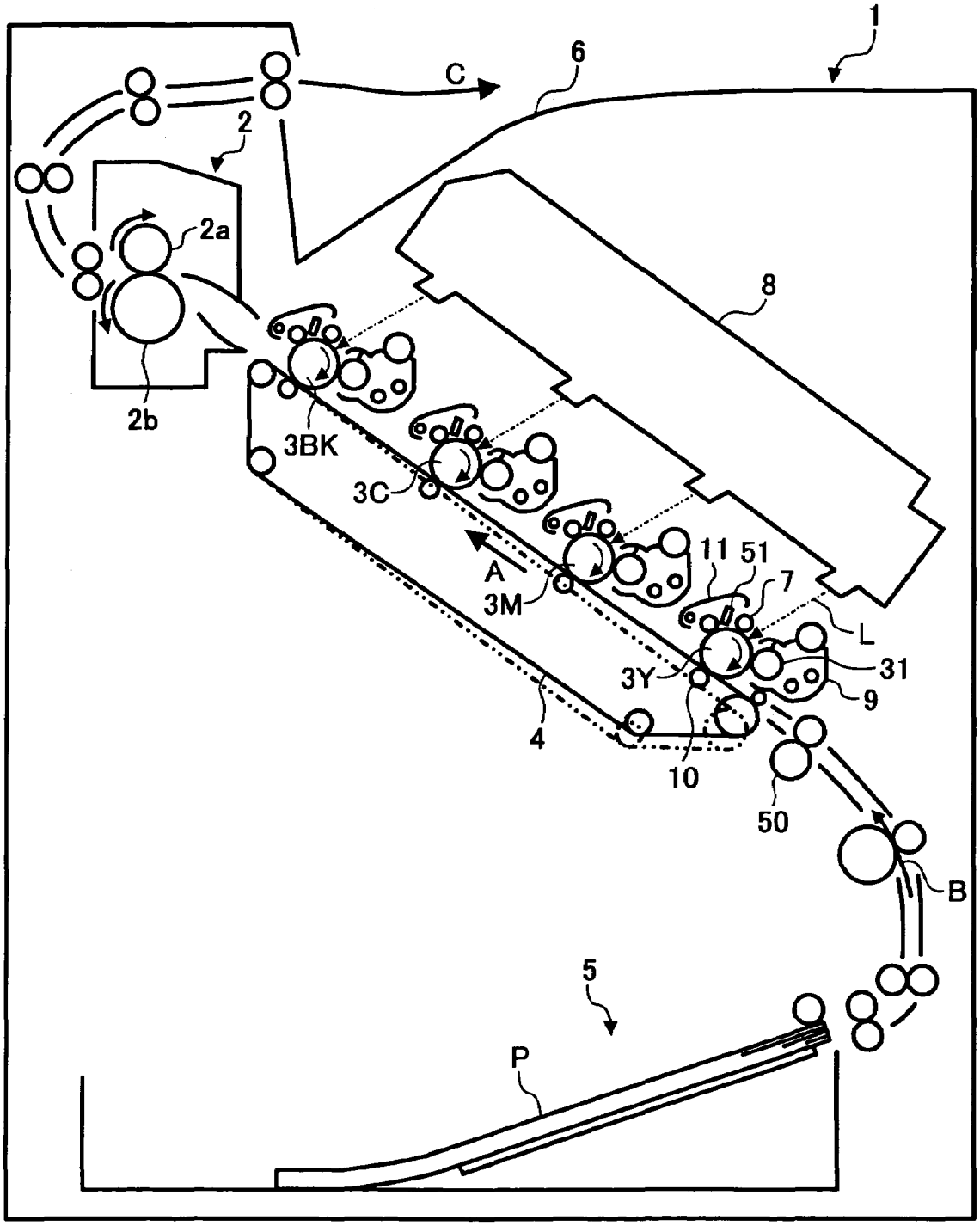
FIG. 1 is a schematic view of an image forming apparatus according to an embodiment of the present invention.

Preferred embodiments of the present invention are described in detail referring to the drawings, wherein like reference numerals designate identical or corresponding parts throughout the several views.

FIG. 1 is a schematic view of an image forming apparatus according to an embodiment of the present invention. Referring to FIG. 1, a main body 1 of the image forming apparatus includes a plurality of photoreceptors 3Y, 3M, 3C, and 3BK functioning as image carriers. Each of the photoreceptors 3Y, 3M, 3C, and 3BK is in a shape of a drum. Chromatic color toner images, such as, a yellow toner image, a magenta toner image, and a cyan toner image are formed and carried on the photoreceptors 3Y, 3M, and 3C, respectively. Further, a black toner image is formed and carried on the photoreceptor 3BK. A recording material conveying belt 4 is disposed opposite to the photoreceptors 3Y, 3M, 3C, and 3BK, and is spanned around a plurality of support rollers and driven to rotate in the direction indicated by arrow (A) in FIG. 1.

The constructions and operations of the photoreceptors 3Y, 3M, 3C, and 3BK are substantially the same except for the color of their toner. For this reason, the construction of the photoreceptor 3Y will be described hereinafter as being representative. The photoreceptor 3Y is driven to rotate in the clockwise direction indicated by the arrow in FIG. 1, and the surface of the photoreceptor 3Y is charged with a predetermined polarity by a charging roller 7. Subsequently, the charged surface of the photoreceptor 3Y is exposed to a light-modulated laser beam (L) emitted from a laser writing unit 8. Thereby, an electrostatic latent image is formed on the surface of the photoreceptor 3Y, and is then developed with a yellow toner and is visualized as a yellow toner image by a developing device 9. The developing device 9 includes a developing roller 31 that carries a developer including a yellow toner.

A recording material (P), such as, a transfer sheet and a resin film, is fed out from a sheet feeding unit 5 disposed at a lower part of the main body 1 in the direction indicated by arrow (B) in FIG. 1. The recording material (P) is conveyed to a nip part between the photoreceptor 3Y and the recording material conveying belt 4 at a predetermined timing by a pair of registration rollers 50. The recording material (P) is then carried and conveyed by the recording material conveying belt 4. A transfer roller 10 is disposed opposite to the photoreceptor 3Y via the recording material conveying belt 4. A yellow toner image on the photoreceptor 3Y is transferred onto the recording material (P) by the action of the transfer roller 10. The residual toner remaining on the photoreceptor 3Y, which has not been transferred onto the recording material (P), is removed by a cleaning device 11. The cleaning device 11 includes a cleaning blade 51 press-contacted with the surface of the photoreceptor 3Y to scrape off the residual toner. The recording material (P) is one of a non-limiting example of a transfer material on which a toner image is transferred.

As in the case of a yellow toner image, magenta, cyan, and black toner images are formed on the photoreceptors 3M, 3C, and 3BK, respectively, and are sequentially transferred onto the recording material (P) on which a yellow toner image has been transferred, while being superimposed each other thereon.

The recording material (P) having a superimposed full-color toner image is conveyed to a fixing device 2. While the recording material (P) passes through between a pair of fixing rollers 2*a* and 2*b*, the color toner image is fixed onto the recording material (P) by the action of heat and pressure. The recording material (P) having a fixed color image is discharged in a direction indicated by arrow (C) in FIG. 1 and stacked on a sheet discharging section 6. Thus, the recording material (P), on which a color image is formed, is obtained.

The above-described color image forming operations are performed in a color mode. In addition to the color mode, a monochrome mode, in which a mono-color (i.e., black) image is formed on a recording material, can be selected in the image forming apparatus of the present embodiment. In the monochrome mode, the recording material conveying belt 4 is separated from the photoreceptors 3Y, 3M, 3C on which chromatic color toner images are formed, as indicated by a chain double-dashed line in FIG. 1, and is brought into contact with the photoreceptor 3BK on which a black toner image is formed. The photoreceptors 3Y, 3M, 3C are not rotated, and only the photoreceptor 3BK is rotated. A black toner image is formed on the photoreceptor 3BK in the similar manner to the yellow toner image. The black toner image is transferred onto the recording material (P) that has been fed from the sheet feeding unit 5 and is conveyed by the registration rollers 50 at an appropriate timing. The recording material (P) having a transferred black toner image is carried and conveyed by the recording material conveying belt 4 rotated in the direction indicated by the arrow (A). While the recording material (P) passes through the fixing device 2, the black toner image is fixed on the recording material (P). The recording material (P) having a fixed black image is discharged and stacked on the sheet discharging section 6.

Figure 2:
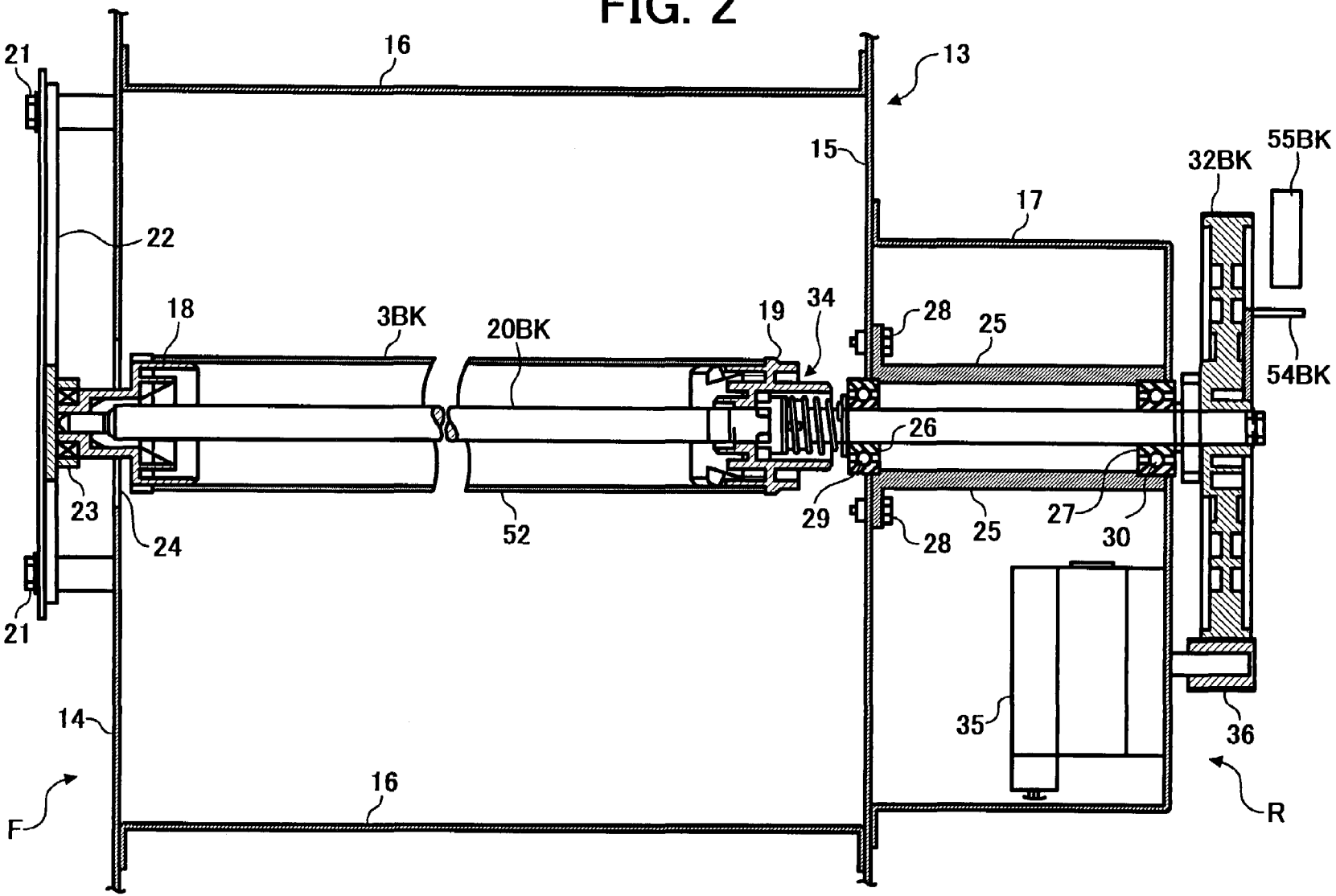
FIG. 2 is a sectional view of a support construction for a photoreceptor on which a black toner image is formed and a transmission mechanism that transmits a drive force to the photoreceptor according to an embodiment of the present invention.

FIG. 2 is a sectional view of a support construction for the photoreceptor 33K and a transmission mechanism that transmits a drive force to the photoreceptor 3BK according to an embodiment of the present invention. In FIG. 2, a reference character (F) indicates a front side of the main body 1 of the image forming apparatus, and a reference character (R) indicates a rear side thereof. As illustrated in FIG. 2, the photoreceptor 3BK includes a photoreceptor main body 52 formed from a drum, and front and rear flanges 18 and 19 that are fixed at end portions of the photoreceptor main body 52 in its axial direction. A black toner image is formed on the peripheral surface of the photoreceptor main body 52. The photoreceptors 3Y, 3M, and 3C, on which chromatic color toner images are formed, are constructed in the same manner to the photoreceptor 3BK.

Referring to FIG. 2, a main body frame 13 of the main body 1 of the image forming apparatus includes a front side plate 14 located at the front side of the main body 1, a rear side plate 15 located at the rear side of the main body 1, a stay 16 that connects the front side plate 14 to the rear side plate 15, and a main body bracket 17 secured to the rear side plate 15 with screws (not shown). The rear flange 19 is connected to a rotation shaft 20BK via a coupling 34 such that the rear flange 19 is unrotatable relative to the rotation shaft 20BK. The photoreceptor 3BK is configured to rotate integrally with the rotation shaft 20BK.

A positioning member 22 is detachably secured to the front side plate 14 with a plurality of screws 21. The front flange 18 is rotatably supported by the positioning member 22 via a bearing 23. The front side end portion of the rotation shaft 20BK is detachably engaged with the front flange 18. The front flange 18 and the front side part of the rotation shaft 20BK pass through a hole 24 formed in the front side plate 14. The rear side part of the rotation shaft 20BK passes and extends through the rear side plate 15 and the main body bracket 17, and is rotatably supported by a pair of ball bearings 26 and a pair of ball bearings 27 held by a pair of cylindrical-shaped holders 25. The holders 25 are detachably secured to the rear side plate 15 with screws 28. Respective outer rings of the ball bearings 26 and 27 are fitted into holes 29 and 30 formed in the rear side plate 15 and the main body bracket 17, respectively, without a rattle, thereby positioning the ball bearings 26 and 27 and the holders 25 relative to the main body frame 13. Thus, the rotation shaft 20BK is rotatably supported by the main body frame 13 while being adequately positioned relative to the main body frame 13. Further, the photoreceptor 3BK is coaxially provided with the rotation shaft 20BK via the front flange 18 and the rear flange 19. Further, at the rear side end part of the rotation shaft 20BK, a drive gear 323K is coaxially fixed to the rotation shaft 20BK.

Figure 3:
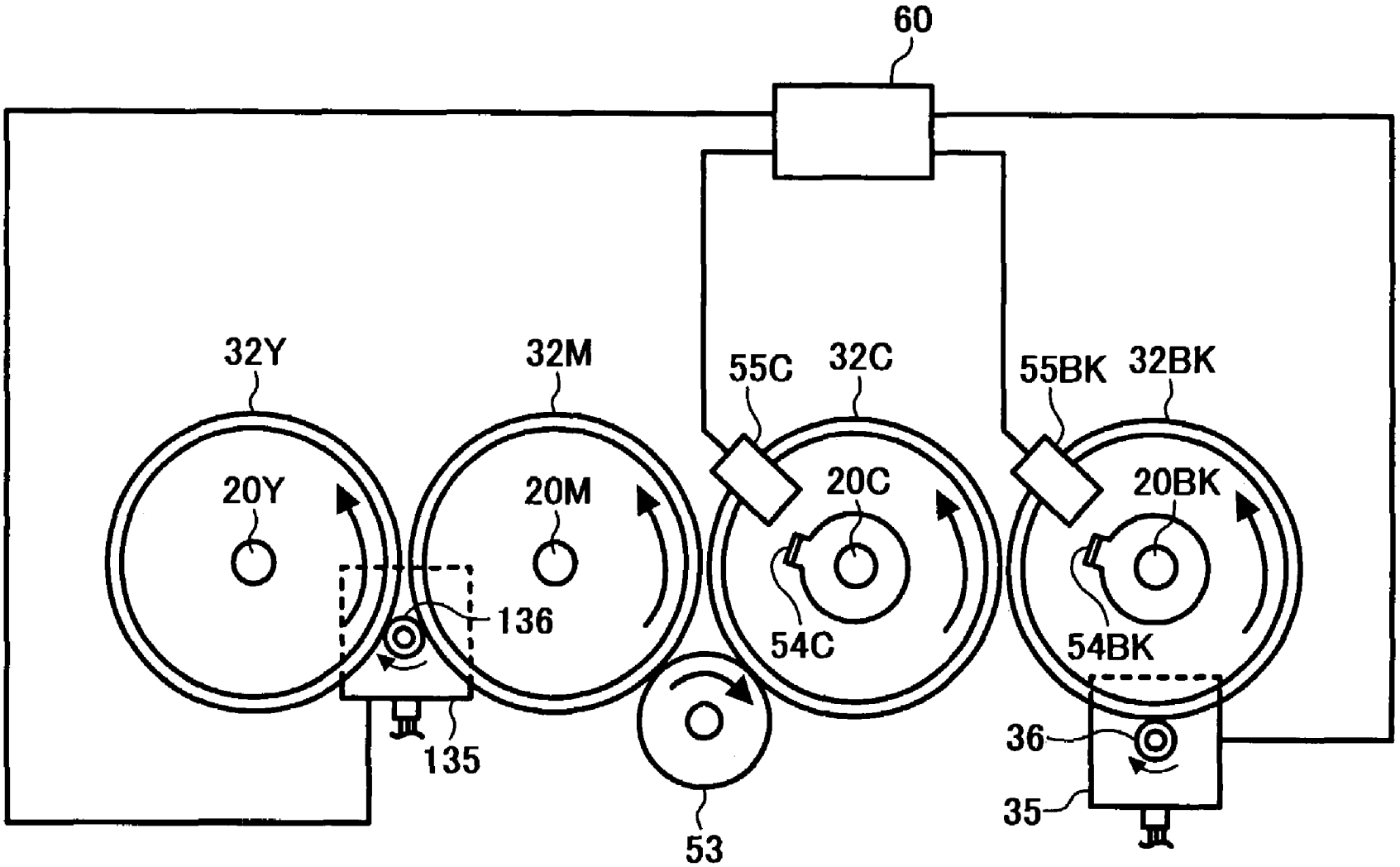
FIG. 3 is a schematic view of color gears and a black gear seen from a right side of FIG. 2.

As in the case of the photoreceptor 3BK, the photoreceptors 3Y, 3M, and 3C are rotatably supported by the main body frame 13. Further, a drive gear is fixed to the rear side end part of each of rotation shafts of the photoreceptors 3Y, 3M, and 3C. FIG. 3 is a schematic view of drive gears 32Y, 32M, 32C, and 32BK for the photoreceptors 3Y, 3M, 3C, and 3BK seen from the rear side (i.e., the right side in FIG. 2) of the image forming apparatus. Referring to FIG. 3, the drive gear 32BK is fixed to the rotation shaft 20BK for the photoreceptor 3BK, and the drive gears 32Y, 32M, and 32C are coaxially fixed to the rear side end parts of rotation shafts 20Y, 20M, and 20C, respectively, for the photoreceptors 3Y, 3M, and 3C. Because the respective support constructions for the photoreceptors 3Y, 3M, and 3C are substantially the same as the support construction for the photoreceptor 3BK, their descriptions are omitted here.

As illustrated in FIGS. 2 and 3, a first drive motor 35 is supported by the main body bracket 17 (illustrated in FIG. 2). An output gear 36 fixed onto an output shaft of the drive motor 35 is engaged with the drive gear 32BK. The drive force of the drive motor 35 is transmitted to the rotation shaft 20BK via the output gear 36 and the drive gear 32BK, thereby rotating the rotation shaft 20BK in a counterclockwise direction indicated by an arrow in FIG. 3. Subsequently, the drive force is transmitted from the rotation shaft 20BK to the rear flange 19 via the coupling 34, thereby rotating the photoreceptor 3BK in a clockwise direction indicated by an arrow in FIG. 1.

As illustrated in FIG. 3, a second drive motor 135 is fixedly supported by the main body bracket 17. An output gear 136 fixed onto an output shaft of the drive motor 135 is engaged with the drive gear 32Y for the photoreceptor 3Y on which a yellow toner image is formed, and is engaged with the drive gear 32M for the photoreceptor 3M on which a magenta toner image is formed. Further, an intermediate gear 53 illustrated in FIG. 3 is rotatably supported by the main body bracket 17. The intermediate gear 53 is engaged with the drive gear 32M, and with the drive gear 32C for the photoreceptor 3C on which a cyan toner image is formed. The drive force of the drive motor 135 is transmitted to the drive gears 32Y and 32M via the output gear 136, thereby rotating the drive gears 32Y and 32M in counterclockwise directions indicated by arrows in FIG. 3, respectively. Subsequently, the drive force is transmitted from the drive gear 32M to the drive gear 32C via the intermediate gear 53, thereby rotating the drive gear 32C in a counterclockwise direction indicated by an arrow in FIG. 3. Further, the drive forces are transmitted from the drive gears 32Y, 32M, and 32C to the rotation shafts 20Y, 20M, and 20C and to respective rear flanges (not shown) of the photoreceptors 3Y, 3M, and 3C via couplings (not shown), respectively, thereby rotating the photoreceptors 3Y, 3M, and 3C in clockwise directions indicated by arrows in FIG. 1, respectively.

In the image forming apparatus of the present embodiment, respective toner images formed on the photoreceptors 3Y, 3M, 3C, and 3BK are directly transferred from the photoreceptors 3Y, 3M, 3C, and 3BK onto a transfer material, such as, a recording material (e.g., a sheet). Alternatively, toner images may be primarily transferred onto an intermediate transfer element, such as, a drum and an endless belt while being superimposed each other thereon, and a superimposed full-color toner image may be secondarily transferred onto a recording material. In this case, the intermediate transfer element may function as a transfer material on which a toner image is transferred from a photoreceptor.

Hereinafter, when it is not necessary to differentiate the photoreceptors 3Y, 3M, and 3C on which chromatic color toner images are formed, the photoreceptors 3Y, 3M, and 3C may be referred to as "color photoreceptors" as a whole. Further, the photoreceptor 3BK may be referred to as a "black photoreceptor", if necessary. Moreover, the drive gears 32Y, 32M, and 32C for driving the photoreceptors 3Y, 3M, and 3C may be referred to as "color gears" as a whole, and the drive gear 32BK for driving the photoreceptor 3BK may be referred to as a "black gear". The image forming apparatus illustrated in FIG. 1 includes the three photoreceptors 3Y, 3M, and 3C. As a non-limiting example, the image forming apparatus may include at least one of the photoreceptors 3Y, 3M, and 3C. In this case, a color image, which is formed from at least two color toner images (i.e., at least one of yellow, magenta, and cyan toner images and a black toner image), may be formed in a color mode.

As described above, in a color mode, chromatic color toner images are formed on the color photoreceptors rotated by the color gears, and a black toner image is formed on the black photoreceptor rotated by the black gear. A color image is obtained by transferring the chromatic color toner images and the black toner image onto a transfer material while superimposing each other thereon. In a monochrome mode, the color gears and color photoreceptors are halted. A black toner image is formed on the black photoreceptor rotated by the black gear. A black image is obtained by transferring the black toner image onto a transfer material. An operator of the image forming apparatus can select the color mode and the monochrome mode.

In the image forming apparatus of the present embodiment, the black photoreceptor and the color photoreceptors are driven independently by separate drive motors. Specifically, the photoreceptor 3BK is driven by the drive motor 35, and the photoreceptors 3Y, 3M, and 3C are driven by the drive motor 135. Alternatively, the black photoreceptor and the color photoreceptors may be driven by a single drive motor. In this case, the black photoreceptor and the color photoreceptors may be driven independently by transmitting a drive force of the single drive motor to the black photoreceptor and the color photoreceptors via clutches.

Each radius and construction of the drive gears 32BK, 32Y, 32M, and 32C is substantially the same. For example, the drive gears 32BK, 32Y, 32M, and 32C are formed from materials, such as, resin and metal. Especially when these gears are formed from resin, it may be inevitable that these gears become slightly eccentric. In this condition, toner images of different colors may be transferred to a recording material (P) with their positions slightly deviated from each other, thereby causing the deviation of the position of color toner images, that is, color misregistration in a color image.

Figure 4:
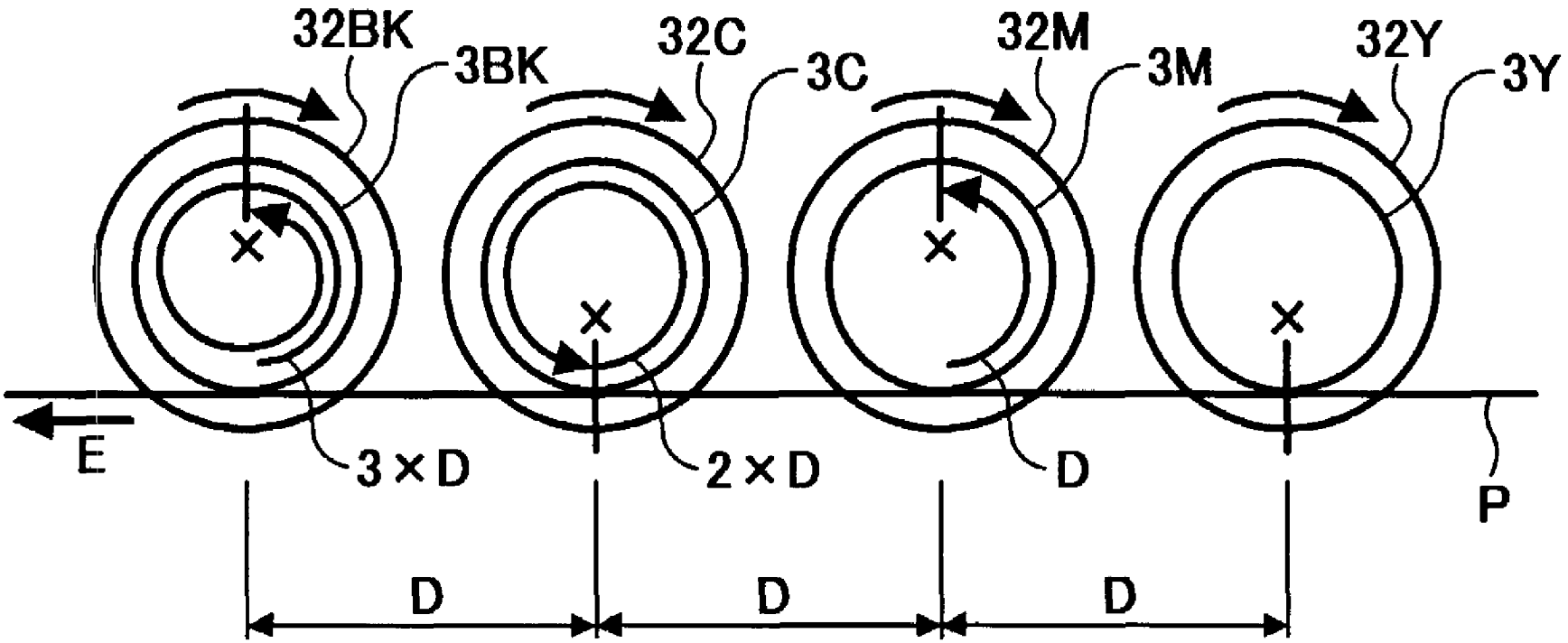
FIG. 4 is a schematic view for explaining phase relations between the black and color gears.

To avoid the deviation of the position of color toner images, in the image forming apparatus of the present embodiment, the drive gears 32Y, 32M, 32C, and 32BK are arranged while having predetermined phase relations with each other in their rotational directions, similarly as in a conventional color image forming apparatus. FIG. 4 is a schematic view for explaining phase relations between the drive gears 32Y, 32M, 32C, and 32BK. Further, FIG. 4 illustrates the drive gears 32Y, 32M, 32C, and 32BK and the photoreceptors 3Y, 3M, 3C, and 3BK seen from the front side (i.e., the left side in FIG. 2) of the image forming apparatus. In FIG. 4, a reference character (D) indicates a distance between transfer positions where toner images are transferred from the photoreceptors 3Y, 3M, 3C, and 3BK to a recording material (P). Further, a reference character (X) indicates a reference position of the outer peripheral surface of each of the photoreceptors 3Y, 3M, 3C, and 3BK in the peripheral direction, and a reference position of each of the drive gears 32Y, 32M, 32C, and 32BK corresponding to the reference position of each of the photoreceptors 3Y, 3M, 3C, and 3BK. Moreover, a reference character (E) indicates a direction of conveyance of a recording material (P). The drive gears 32Y, 32M, 32C, and 32BK are formed from resin and molded in the same molding die.

In FIG. 4, the reference position (X) of the photoreceptor 3Y on which a yellow toner image is formed, is located at the transfer position, and a yellow toner image on the photoreceptor 3Y is transferred to a recording material (P). At this time, the reference position (X) of the photoreceptor 3M located next to the photoreceptor 3Y is located at a position away from the transfer position for the yellow toner image by the distance (D) on the upstream side of the rotational direction of the photoreceptor 3M. Further, the reference position (X) of the photoreceptor 3C is located at a position away from the transfer position for the yellow toner image by double distance (D), i.e., 2×D, on the upstream side of the rotational direction of the photoreceptor 3C. Further, the reference position (X) of the photoreceptor 3BK is located at a position away from the transfer position for the yellow toner image by triple distance (D), i.e., 3×D, on the upstream side of the rotational direction of the photoreceptor 3BK. To have the above-described positional relation, the drive gears 32Y, 32M, 32C, and 32BK and the photoreceptors 3Y, 3M, 3C, and 3BK are attached such that the respective reference positions of the drive gears 32Y, 32M, 32C, and 32BK and the respective reference positions of the photoreceptors 3Y, 3M, 3C, and 3BK are located at the positions shown in FIG. 4. With such a positional relation, even if the drive gears 32Y, 32M, 32C, and 32BK are slightly eccentric, toner images of respective colors are adequately superimposed each other thereon, thereby preventing the deviation of the position of color images on the recording material (P). The attachment angle positions of the drive gears 32Y, 32M, 32C, and 32BK are set so as not to cause color misregistration in a color image.

The image forming apparatus of the present embodiment includes a control device (describe below) that controls rotation stop-positions of the color gears 32Y, 32M, 32C and the black gear 32BK to prevent local damage of the color gears and black gear and to prevent the change of predetermined phase relations between the color gears and the black gear. Specifically, in the color mode, the control device causes the color gears 32Y, 32M, 32C and the black gear 32BK to stop at positions different from their rotation start-positions, respectively, while maintaining predetermined phase relations between the color gears 32Y, 32M, 32C and the black gear 32BK. Further, in the monochrome mode, the control device causes the black gear 32BK to stop at a position equal to its rotation start-position.

Hereinafter, the control operation of rotation stop-positions of the color gears and the black gear performed by the control device will be described.

Referring to FIGS. 2 and 3, a reference portion constructed from a reference protrusion 54BK is fixed to the black gear 32BK, and a reference portion constructed from a reference protrusion 54C is fixed to the color gear 32C. Further, sensors 55BK and 55C are provided opposite to the gears 32BK and 32C, respectively. The sensors 55BK and 55C are fixedly supported by the main body bracket 17 via attachment plates (not shown). Moreover, as illustrated in FIG. 3, a controller 60 including a central processing unit (CPU) is connected to the sensors 55BK and 55C and the drive motors 35 and 135. The control device according to the embodiment of the present invention includes the reference portions constructed from the reference protrusions 54BK and 54C, the sensors 55BK and 55C that detect the reference protrusions 54BK and 54C, respectively, and the controller 60.

When the sensors 55C and 55BK detect the reference protrusions 54C and 54BK, respectively, when a first image forming operation in the color mode is completed, the controller 60 outputs motor stop signals based on detection signals generated by the sensors 55C and 55BK. With the motor stop signals, the drive motors 35 and 135 stop, thereby stopping the rotations of the color gears 32Y, 32M, 32C and the black gear 32BK. When a second image forming operation in the color mode starts, the drive motors 35 and 135 are actuated, thereby rotating the color gears 32Y, 32M, 32C and the black gear 32BK. At this time, the color gears 32Y, 32M, 32C and the black gear 32BK start rotating from the positions where the gears 32Y, 32M, 32C and 32BK stop in the preceding image forming operation.

When the second image forming operation is completed, the controller 60 outputs motor stop signals after a predetermined time, e.g., 10 microseconds, has elapsed from when the sensors 55C and 55BK detect the reference protrusions 54C and 54BK, respectively. With the motor stop signals, the drive motors 35 and 135 stop, thereby stopping the rotations of the color gears 32Y, 32M, 32C and the black gear 32BK. Thus, the stop-positions of the color gears 32Y, 32M, 32C and the black gear 32BK in the second image forming operation are different from their stop-positions in the first image forming operation, respectively.

When the third image forming operation in the color mode is completed, the controller 60 outputs motor stop signals after a predetermined time, which is longer than that in the second image forming operation, e.g., 20 microseconds, has elapsed from when the sensors 55C and 55BK detect the reference protrusions 54C and 54BK, respectively. With the motor stop signals, the drive motors 35 and 135 stop, thereby stopping the rotations of the color gears 32Y, 32M, 32C and the black gear 32BK. Thus, the stop-positions of the color gears 32Y, 32M, 32C and the black gear 32BK in the third image forming operation are different from their stop-positions in the second image forming operation, respectively.

The above-described control operation of the stop-positions of the color gears 32Y, 32M, 32C and the black gear 32BK is performed each time when an image forming operation is performed in the color mode. When image forming operations are performed a predetermined number of times in the color mode, the control operation of the stop-positions of the color gears and the black gear is reset. That is, immediately after the sensors 55C and 55BK detect the reference protrusions 54C and 54BK, respectively, the controller 60 outputs motor stop signals, thereby stopping the rotations of the color gears 32Y, 32M, 32C and the black gear 32BK. Subsequently, the above-described control operations are repeated. In this embodiment, at least two rotation stop-positions are set in each of the gears. Each of the gears stops at the at least two rotation stop-positions sequentially.

With the above-described control operation of the rotation stop-positions of the gears, the color gears 32Y, 32M, 32C and the black gear 32BK stop at positions different from their rotation start-positions, respectively. Therefore, when the color gears 32Y, 32M, 32C and the black gear 32BK stop rotating, the color gears 32Y and 32M sequentially engage with the output gear 136 at different positions, the color gears 32M and 32C sequentially engage with the intermediate gear 53 at different positions, and the black gear 32BK sequentially engages with the output gear 36 at different positions. Thus, local abrasions of the gears 32Y, 32M, 32C and 32BK are prevented, thereby extending useful life of the drive gears 32Y, 32M, 32C and 32BK. Further, the photoreceptors 3BK, 3C, 3M, and 3Y respectively stop at positions different from their rotation start-positions. Therefore, when the photoreceptors 3BK, 3C, 3M, and 3Y stop rotating, the cleaning blade 51 does not contact each of the photoreceptors 3BK, 3C, 3M, and 3Y at the same position thereof. Thus, the abrasion of the surface of the photoreceptor due to the contact of the cleaning blade 51 can be controlled.

Further, the reference protrusions 54C and 54BK and the sensors 55C and 55BK are arranged such that the above-described phase relations are maintained between the drive gears 32Y, 32M, 32C and 32BK. The rotation start and stop of each of the drive gears 32Y, 32M, 32C and 32BK are repeated while maintaining the predetermined phase relations between the drive gears 32Y, 32M, 32C and 32BK. With such a construction, the deviation of the position of color images on the recording material (P) can be prevented.

As described above, the color gears 32Y, 32M, 32C and the color photoreceptors 3Y, 3M, 3C are halted in the monochrome mode. In the monochrome mode, if the rotation stop-position of the black gear 32BK is controlled as above, desired phase relations between the color gears 32Y, 32M, 32C and the black gear 32BK become undesirable. To maintain the desired phase relations between the color gears 32Y, 32M, 32C and the black gear 32BK, when an image forming operation in the monochrome mode is completed, the black gear 32BK is controlled to stop at a position equal to its rotation start-position. For example, when the sensor 55BK detects the reference protrusion 54BK when a preceding image forming operation in the monochrome mode is completed, the controller 60 outputs a motor stop signal, thereby stopping the rotation of the black gear 32BK. Further, when the sensor 55BK detects the reference protrusion 54BK when a succeeding image forming operation in the monochrome mode is completed, the drive motor 35 is stopped in accordance with a motor stop signal output from the controller 60. At this time, the black gear 32BK is stopped at the position where the black gear 32BK starts rotating in the succeeding image forming operation in the monochrome mode (i.e., the rotation start-position).

By doing this, the phase relations between the black gear 32BK and the color gears 32Y, 32M, 32C are desirably maintained, and the deviation of the position of the color images (i.e., color misregistration in a color image) is prevented in a succeeding image forming operation in the color mode. Even though the color mode and the monochrome mode are mixed in image forming operations of the image forming apparatus, the phase relations between the black gear 32BK and the color gears 32Y, 32M, 32C are maintained, and a high quality color image free from color misregistration can be obtained. If image forming operations in the monochrome mode are continuously performed, the black gear 32BK may be locally damaged. To avoid local damage of the black gear 32BK, after a predetermined number of black image forming operations are continuously performed, the control device may cause the drive gears 32BK, 32Y, 32M, 32C to equally shift by a predetermined rotation angle. By doing so, local damage of the black gear 32Bk is prevented while maintaining desired phase relations between the drive gears 32BK, 32Y, 32M, 32C.

Generally, before an image forming apparatus is delivered from a factory, color registration of color images is performed. Hereinafter, a mode for performing color registration will be referred to as a "registration mode". Specifically, in the registration mode, each peripheral speed of the registration rollers 50 and the fixing rollers 2*a* and 2*b* is adjusted while adjusting motors (not shown) that drive the registration rollers 50 and the fixing rollers 2*a* and 2*b*. With such an adjustment, toner images of respective colors are transferred from the photoreceptors 3Y, 3M, 3C, 3BK onto a recording material (P) while being superimposed each other thereon. The superimposed color toner image is fixed onto the recording material (P) and is obtained as a color image. These operations for forming color images are performed several times. Then, after several color images are compared to each other, each peripheral speed of the registration rollers 50 and the fixing rollers 2*a* and 2*b* is set such that the deviation of the position of color images becomes minimum. If each peripheral speed of the registration rollers 50 largely differs from each peripheral speed of the photoreceptors 3Y, 3M, 3C, 3BK, a recording material has impact during the conveyance of the recording material, thereby causing color misregistration in a color image. To avoid such color misregistration in a color image, each peripheral speed of the registration rollers 50 is adjusted. As in the case of the registration rollers 50, each peripheral speed of the fixing rollers 2*a* and 2*b* needs to be adjusted.

When forming color images on several recording materials in the registration mode, color images are preferably formed on each recording material under the same conditions as much as possible while maintaining predetermined phase relations between the color gears 32Y, 32M, 32C and the black gear 32BK. By doing so, the obtained color images can be adequately compared to each other. If the rotation stop-positions of the drive gears 32Y, 32M, 32C, 32BK are sequentially changed every time when image forming operations in the registration mode are completed, the data of the obtained color image used for reference data may vary, thereby causing the obtained color images not to be adequately compared to each other.

Therefore, in the registration mode in the image forming apparatus according to the embodiment of the present invention, the control device controls the color gears 32Y, 32M, 32C and the black gear 32BK to stop rotating at positions equal to their rotation start-positions, respectively, while maintaining predetermined phase relations between the color gears 32Y, 32M, 32C and the black gear 32BK. By causing the gears 32Y, 32M, 32C, and 32BK to stop rotating at positions equal to their rotation start-positions, the influence of the eccentricity of the gears 32Y, 32M, 32C, and 32BK can be eliminated. Thus, color images, which have been formed by image forming operations performed under the same conditions in the registration mode, can be accurately judged.

As described above, the control device according to the embodiment of the present invention includes the reference portions constructed from the reference protrusions 54BK and 54C, the sensors 55BK and 55C that detect the reference protrusions 54BK and 54C, respectively, and the controller 60 that controls the respective rotation stop-positions of the color gears 32Y, 32M, 32C and the black gear 32BK based on detection signals generated by the sensors 55C and 55BK. Thus, the construction of the control device of the present embodiment can be simplified. Various kinds of sensors, such as, a photosensor and a microswitch, can be used as the sensors 55C and 55BK.

It is preferable that stepping motors be used as the drive motor 35 that drives the black gear 32BK to rotate and the drive motor 135 that drives the color gear 32Y, 32M, 32C to rotate. As compared to the use of a DC brushless motor, the control device can precisely control rotation stop-positions of the gears 32Y, 32M, 32C, and 32BK by controlling the number of pulses of a stepping motor.

According to the embodiment of the present invention, the black gear 32BK is rotated by the drive motor 35, and the colors gears 32Y, 32M, 32C are rotated by the single drive motor 135. As described above, the drive force of the drive motor 135 is transmitted to the drive gears 32Y and 32M via the output gear 136, thereby rotating the drive gears 32Y and 32M. Subsequently, the drive force is transmitted from the drive gear 32M to the drive gear 32C via the intermediate gear 53, thereby rotating the drive gear 32C. Because the drive gears 32Y, 32M, 32C, and 32BK are driven to rotate by using two drive motors 35 and 135, the number of parts, such as, drive motors and sensors, and the cost of the apparatus can be reduced. Further, because the colors gears 32Y, 32M, 32C are driven to rotate by the common drive motor 135, the phase relations between the colors gears 32Y, 32M, 32C can be accurately maintained.

According to the embodiment of the present invention, local damage of color gears and a black gear can be prevented by controlling rotation stop-positions of the color gears and the black gear, while effectively controlling the deviation of the position of color images, that is, color misregistration in a color image.

The present invention has been described with respect to the exemplary embodiments illustrated in the figures. However, the present invention is not limited to these embodiments and may be practiced otherwise.

Numerous additional modifications and variations of the present invention are possible in light of the above teachings. It is therefore understood that within the scope of the appended claims, the present invention may be practiced other than as specifically described herein.

What is claimed is:

1. An image forming apparatus, comprising:

at least one first image carrier configured to carry a chromatic color toner image formed thereon;

a second image carrier configured to carry a black toner image formed thereon;

at least one first gear configured to rotate to drive the at least one first image carrier to rotate;

a second gear configured to rotate to drive the second image carrier to rotate; and a control device configured to control respective rotation stop-positions of the at least one first gear and the second gear, wherein a color image is formed in a color mode by transferring the chromatic color toner image formed on the at least one first image carrier onto a transfer material and by transferring the black toner image formed on the second image carrier onto the transfer material while superimposing each other on the transfer material, and a black image is formed in a monochrome mode by halting the at least one first gear and the at least one first image carrier and by transferring the black toner image formed on the second image carrier onto the transfer material, and wherein the control device controls the at least one first gear and the second gear to stop rotating at positions different from rotation start-positions of the at least one first gear and the second gear, respectively, while maintaining a predetermined phase relation between the at least one first gear and the second gear in the color mode, and the control device controls the second gear to stop rotating at a position substantially equal to a rotation start-position of the second gear in the monochrome mode.

2. The image forming apparatus according to claim 1, wherein color registration of color images is performed in a registration mode, and wherein the control device controls the at least one first gear and the second gear to stop rotating at positions substantially equal to rotation start-positions of the at least one first gear and the second gear, respectively, while maintaining a predetermined phase relation between the at least one first gear and the second gear in the registration mode.

3. The image forming apparatus according to claim 1, wherein the control device comprises:

at least one first reference portion provided on the at least one first gear;

a second reference portion provided on the second gear;

at least two sensors configured to detect the at least one first reference portion and the second reference portion; and a controller configured to control respective rotation stop-positions of the at least one first gear and the second gear based on detection signals generated by the at least two sensors.

4. The image forming apparatus according to claim 1, further comprising at least one drive motor configured to drive the at least one first gear and the second gear to rotate, wherein the at least one drive motor includes a stepping motor.

5. A multi-color image forming method, comprising:

rotating at least one first gear to drive at least one first image carrier to rotate in a color mode in which a color image is formed, and rotating a second gear to drive a second image carrier to rotate in the color mode and in a monochrome mode in which a black image is formed;

forming a chromatic color toner image on the at least one first image carrier in the color mode, and forming a black toner image on the second image carrier in the color mode and the monochrome mode;

transferring the chromatic color toner image formed on the at least one first image carrier onto a transfer material and transferring the black toner image formed on the second image carrier onto the transfer material while superimposing on the transfer material in the color mode, and transferring the black toner image formed on the second image carrier onto the transfer material in the monochrome mode; and controlling the at least one first gear and the second gear to stop rotating at positions different from rotation start-positions of the at least one first gear and the second gear, respectively, while maintaining a predetermined phase relation between the at least one first gear and the second gear in the color mode, and controlling the second gear to stop rotating at a position substantially equal to a rotation start-position of the second gear in the monochrome mode.

6. The method according to claim 5, further comprising:

controlling the at least one first gear and the second gear to stop rotating at positions substantially equal to rotation start-positions of the at least one first gear and the second gear, respectively, while maintaining a predetermined phase relation between the at least one first gear and the second gear in a registration mode in which color registration of color images is performed.

7. The method according to claim 5, further comprising:

causing the at least one first gear and the second gear to equally shift by a predetermined rotation angle after a predetermined number of black image forming operations are continuously performed in the monochrome mode.

8. An image forming apparatus, comprising:

first image carrying means for carrying a chromatic color toner image formed thereon;

second image carrying means for carrying a black toner image formed thereon;

first rotating means for rotating to drive the first image carrying means to rotate;

second rotating means for rotating to drive the second image carrying means to rotate; and control means for controlling respective rotation stop-positions of the first rotating means and the second rotating means, wherein a color image is formed in a color mode by transferring the chromatic color toner image formed on the first image carrying means onto a transfer material and by transferring the black toner image formed on the second image carrying means onto the transfer material while superimposing each other on the transfer material, and a black image is formed in a monochrome mode by halting the first rotating means and the first image carrying means and by transferring the black toner image formed on the second image carrying means onto the transfer material, and wherein the control means controls the first rotating means and the second rotating means to stop rotating at positions different from rotation start-positions of the first rotating means and the second rotating means, respectively, while maintaining a predetermined phase relation between the first rotating means and the second rotating means in the color mode, and the control means controls the second rotating means to stop rotating at a position substantially equal to a rotation start-position of the second rotating means in the monochrome mode.

9. The image forming apparatus according to claim 8, wherein color registration of color images is performed in a registration mode, and wherein the control means controls the first rotating means and the second rotating means to stop rotating at positions substantially equal to rotation start-positions of the first rotating means and the second rotating means, respectively, while maintaining a predetermined phase relation between the first rotating means and the second rotating means in the registration mode.

10. The image forming apparatus according to claim 8, wherein the control means comprises:

at least one first reference portion provided on the first rotating means;

a second reference portion provided on the second rotating means;

detecting means for detecting the at least one first reference portion and the second reference portion; and controller means for controlling respective rotation stop-positions of the first rotating means and the second rotating means based on detection signals generated by the detecting means.

11. The image forming apparatus according to claim 8, further comprising drive means for driving the first rotating means and the second rotating means to rotate, wherein the drive means includes a stepping motor.

* * * * *